United States Patent [19]

O'Kon et al.

[11] 3,962,981

[45] June 15, 1976

[54] BARGE FACTORY

[75] Inventors: James O'Kon, Atlanta, Ga.; William Magness, Jackson Heights, N.Y.

[73] Assignee: Shoreline Precast Company, New York, N.Y.

[22] Filed: Jan. 20, 1975

[21] Appl. No.: 542,489

[52] U.S. Cl. ..... 114/.5 F

[51] Int. Cl.[2] ..... B63B 35/28

[58] Field of Search ..... 114/.5 F, 26, 28, 30, 114/31, 43.5 R, 77 R, 125, 235 R, 235 A

[56] References Cited

UNITED STATES PATENTS

| | | | |
|---|---|---|---|
| 1,000,152 | 8/1911 | Correll | 114/125 |
| 3,109,406 | 11/1963 | Stockdale | 114/235 R |
| 3,785,314 | 1/1974 | Scanlan | 114/.5 F |

FOREIGN PATENTS OR APPLICATIONS

| | | | |
|---|---|---|---|
| 1,523,455 | 5/1968 | France | 114/.5 F |

*Primary Examiner*—Trygve M. Blix
*Assistant Examiner*—Sherman D. Basinger
*Attorney, Agent, or Firm*—Brumbaugh, Graves, Donohue & Raymond

[57] ABSTRACT

A floating factory for the manufacture of structural and other large, heavy components of buildings and other products comprises a multiplicity of floating barges positioned adjacent each other to form a continuous work area and are connected together as a flotilla in a manner that allows controlled movement of the flotilla under wave action, wind loads, the transfer of live loads about the work area by distributing forces among the barges. The connecting system between barges includes (1) shear plate connectors for transferring vertical forces between adjacent barges and maintaining the edges of adjacent barges at the same elevation while allowing the barges to move toward and away from each other and to slide parallel relative to each other, and (2) cable ties between the barges for transferring horizontally acting, tensile forces from barge to barge. Each barge has several separate ballast compartments distributed along its length and width, and a ballast control system for selectively filling and emptying the individual compartments to maintain the deck of the barge in an essentially horizontal orientation. The ballast systems of all barges are, moreover, monitored and controlled to maintain the decks of all of the barges in substantially the same plane. A lightweight, durable, removable roof skin stretched over a semi-permanent framework can be removed to permit the barges to be moved from job to job without disassembling the superstructure and without the risk of damage to the roof skin or "sail action" during transit of the barge.

6 Claims, 12 Drawing Figures

FIG. 10
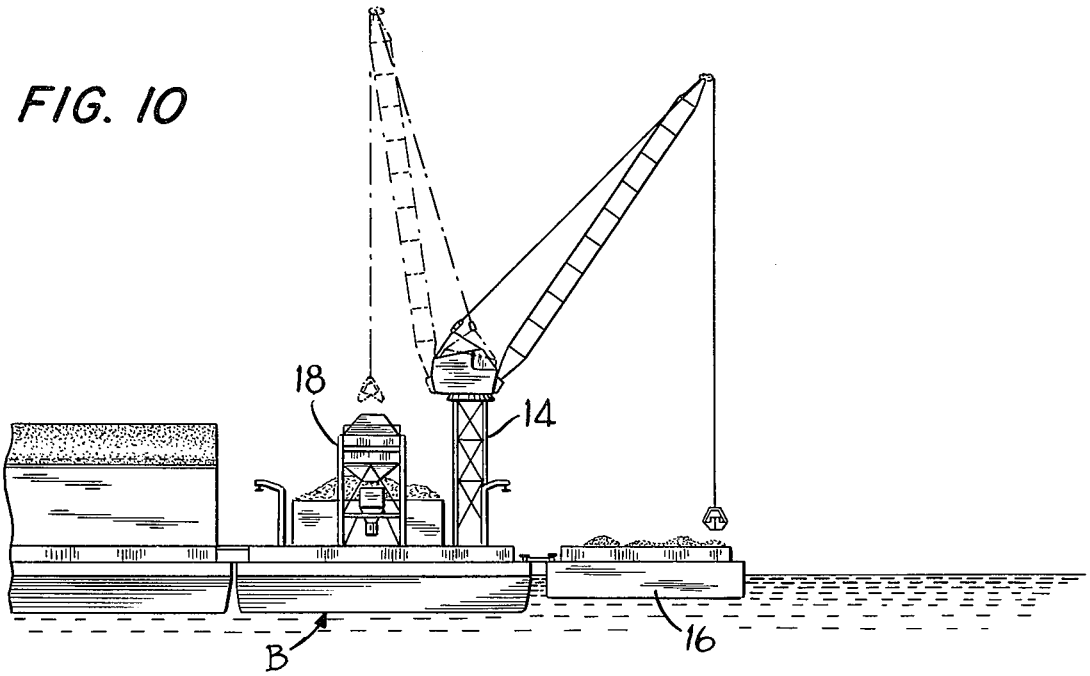
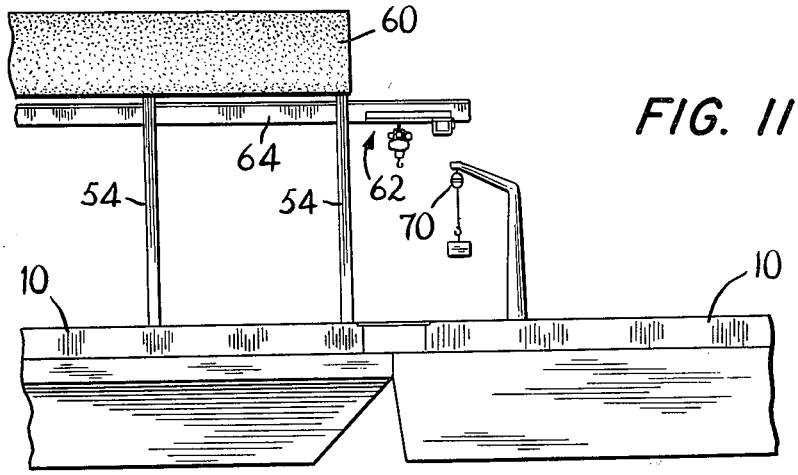
FIG. 11
FIG. 12
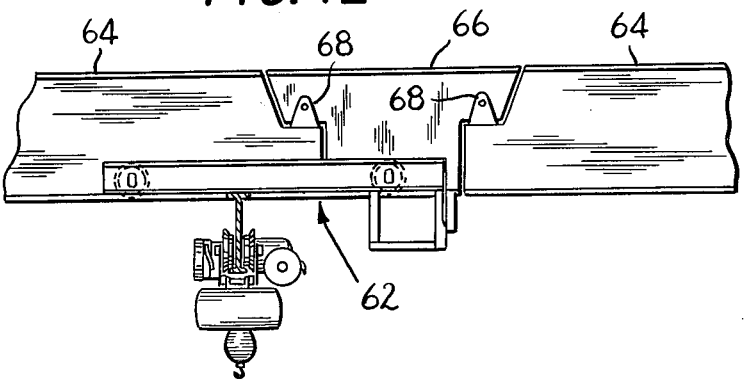

BARGE FACTORY

This invention relates to a floating factory for the manufacture of structural and other large heavy components of buildings and of any other large heavy products based on an assemblage or flotilla of individual barges that are connected to each other to provide a large, essentially continuous work area and that can readily be disconnected, partially dismantled and moved individually to various sites.

The fulfillment of the ever increasing needs for buildings for residential and commercial purposes has compelled the development of techniques for the mass production of buildings by factory assembly-line techniques, as compared to the traditional on-site construction procedures of the past. The economic advantage of the mass production of structural components of buildings is, however, offset by a number of limiting factors that, in many cases, have hampered widespread use of the factory production of buildings. Among the more important problems of efficient building from prefabricated, factory-made components is the difficulty of transporting relatively large, heavy components from a factory to the building site. The factory must be located near rail and highway facilities, which is a definite limitation of the availability of land area on which factories can be built. The greater the distance from the factory to the building site, the greater is the cost of transporting the components to the site from the factory, and there is a practical limit on the distance over which components can economically be transported. Those and other problems of factories that serve a fairly large geographic region have tended to restrict the growth of modular, prefabricated construction techniques, both in the United States and abroad.

Some of the problems of regional factories are avoided by constructing a temporary, on-site factory on land at the construction site or very nearby, and the costs of constructing the temporary, on-site factory can sometimes more than offset the transportation costs involved in bringing products from a remotely located regional factory. On the other hand, the capital costs of building a temporary factory at the building site limit the use of on-site temporary factories to relatively large building projects. When an on-site temporary factory is used in a construction project, its existence at the site, in that it occupies land that might otherwise be used for construction, must be considered as an important disadvantage and is an additional cost factor. In heavily populated areas, it is frequently uneconomical to construct a temporary factory, since the value of the land on which the factory is located as a site for buildings that are part of the project may exceed the cost savings afforded by the on-site factory.

U.S. Pat. NO. 3,785,314, which is assigned to the assignee of the present invention, describes and shows a floating factory for the manufacture of building components and other large and heavy products that very effectively overcomes many of the problems of land-based permanent regional factories and on-site temporary factories. Nearly all heavily developed land throughout the world is located on or near a waterway that readily permits the movement of even large deck barges to locations near land available for development. The factory described in that patent and the improved factory, according to the present invention, comprise a multiplicity of separate floating barges arranged in adjacent relation to form an essentially continuous work area. The barges are connected together to maintain the work area generally stable under conditions of water motion, wind loads, and transfer of forces and live loads from barge to barge, the form of connection between the barges, however, permitting restrained and controlled movement of the flotilla in response to extreme forces that may be imposed upon it. One objective of the connection system is to maintain the edges of adjacent barges at substantially the same level, regardless of wave action and force and live load transfer, inasmuch as the material handling systems suitable for the factory and the flow of work about the factory makes it desirable to maintain the same deck level for all of the barges, or at least certain groups of barges.

The connecting system comprises shear plate connectors placed strategically at junctures between adjacent barges for maintaining the decks of the adjacent barges at essentially the same level and affording a transfer of vertical forces between adjacent barges. At the same time, however, the shear plate connectors afford little resistance to movement of adjacent barges toward and away from each other and parallel to each other. Horizontal forces are transferred between adjacent barges by controlled tension cable ties. The combination of vertical shear connectors and cable ties ensures maintenance of a level, horizontal, stable work area at relatively low cost and with the advantages of ease of connecting and disconnecting the barges and the safety factor of controlled failure of the connections under severe loading. The splitting of a vertical and horizontal force transfer between two connecting systems (shear plates and cable ties) eliminates the difficulty and great expense involved in a single connecting element which must be designed for all forces.

The present invention also provides, as another aspect of the maintenance of a level, planar work area, for the controlled ballasting of each barge in response to changes in loading as live loads are moved on and off the flotilla or moved from one barge to another. The maintenance of a predetermined displacement for all barges in the factory includes the provision on each barge of separate ballast compartments distributed along the length and width of the barge and a ballast system that is monitored and controlled selectively to fill or empty the individual compartments such that the ballast on each barge is located to maintain the barge level (i.e., in a horizontal plane) and to ballast each barge relative to all other barges so that the decks of all barges lie at the same level (i.e., in a single plane). The ballasting of the barges of the factory is controlled in accordance with load changes by monitoring the movement of loads on and off the factory as a whole and from barge to barge. For example, when large loads of raw material are brought onto the cement batching and mixing barge, the ballast system adds ballast to all of the other barges in the factory, and takes ballast off the cement batching and mixing barge so that the deck area remains level. Generally, the objective in the operation of the ballast system is to provide a minimum ballast in the most heavily loaded barge, although the most heavily loaded barge will be ballasted to make the deck level, and ballast of other barges of the factory with sufficient ballast load, properly distributed, to bring their decks to the level of the most heavily loaded barge.

In addition to monitoring movements of loads onto and off and among the barges and controlling the ballast of the flotilla in accordance with the loading conditions as they change, the ballasting system may also include devices for detecting changes in the orientations of the decks of the individual barges, which, of course, will reflect changes in the loading conditions on the several barges. When the level detector system detects predetermined changes in the orientations of the barges, the ballast system is operated in response to the detected changes in orientation to restore the work area to the desired substantially flat level condition. Control of the ballasting system can also be derived from monitoring the loadings of various shear plate connections, such shear plate loadings being indicative of unbalanced loads on individual barges relative to the barges adjacent to them. For example, if the shear plate connectors between adjacent barges are subject to high loading, that indicates that one barge is transferring an excessive load to an adjacent barge and warrants adjusting the ballast as between those two barges. Thus, by a combination of monitoring live load changes, changes in the level of individual barges and changes in loadings on the shear plate connectors or by monitoring any of those factors separately, the work area may be maintained level, notwithstanding substantial changes in load condition. Any monitoring system will, of course, be built to detect and respond only to steady-state changes in positions and force transfers, as distinguished from short duration changes in positions of or force transfers between barges due to water motion or other transient conditions.

It is desirable, and perhaps necessary in severe climates, to provide enclosures over the work area of the several barges, preferably by providing a superstructure on each barge composed of a framework that is designed to be easily assembled and disassembled and lightweight, durable skins or panels that are easily fastened to the framework. The roof over each barge preferably is in the form of a durable, flexible sheet material, such as a highly durable waterproof fabric that is stretched over the roof framing and secured at least at the perimeter and possibly at selected spacing in a manner that permits it to be easily removed to minimize possible damage when the barge is in transit from one site to another. The framework of the superstructure can be designed to support overload crane equipment, as well as to support the enclosure for the work area.

The individual barges of the factory are preferably shaped and dimensioned as modules so that they can be placed together in various arrangements. For example, all of the barges may be rectangular, the length being an integer multiple of the width. A practical size for each barge is 60 feet × 180 feet. Each barge is preferably subdivided into approximately square bays by columns located at the corner of each bay. The number of barges in the flotilla, and the fitting out of the individual barges will vary significantly, depending upon the production operations that will go on in the factory. A highly flexible factory providing a high rate of production comprises, for example, six barges, each of which measures 60 feet × 180 feet. For additional flexibility in the layout and use of the factory, particularly with respect to moving the barges from one place to another, either by towing them or, for movement over exceptionally long distances, by carrying them aboard ships, or to accommodate the factory in a relatively confined body of water that warrants an unusual placement of the barges, the size of the barges may be reduced and the number of barges increased. It is apparent, of course, that the fitting out of individual barges depends not only on the end use but also on the size inasmuch as, obviously, larger size barges can carry more equipment and provide for more operations than smaller size barges.

Regardless of the end use of the factory, assuming, however, that the factory will be used to manufacture generally the same type of products, many of the barges can be essentially permanently fitted out with appropriate facilities to carry on desired functions. For example, the facilities of a factory for manufacturing reinforced or prestressed concrete structural components for buildings will include a barge having permanent concrete batching and mixing equipment and storage bins for raw materials. Another barge will be an office-laboratory facility suitably equipped for the quality control, planning and management functions associated with a factory and accommodations for the comfort of the personnel. Another permanently fitted out barge may have diesel-powered generators, air compressors, boilers and other similar types of equipment. One or more curing barges and certain finishing and fabricating barges may also be essentially self-contained and permanently fitted with the required facilities. To the extent that permanent facilities exist on each of the barges, the dismantling of the factory upon completion of one job, the movement to another site for the new job and the reassembly at the new site are accomplished quickly and economically, thus affording maximum utilization of the capital investment involved while providing the flexibility and economic advantages of providing a factory close to a construction site.

In many instances, the factory can be located sufficiently close to land to provide for land access by bridging or landfill between it and the shore, thereby facilitating the supply of raw materials to the factory and the movement of finished products from the factory to the site. The location of the factory on water will, in many instances, offer substantial economies in bringing raw materials, particularly cement and aggregates to the factory by barge or ship. The factory can, of course, be located well offshore, in which case additional barges can be provided for transporting raw materials and products to and from the shore.

For a better understanding of the invention, reference may be made to the following description of an exemplary embodiment, taken in conjunction with the figures of the accompanying drawings, in which:

FIG. 10 is a generally schematic end elevational view of a batching and mixing plant located on one of the barges of the factory;

FIG. 11 is a generally schematic elevational view depicting two types of overhead material handling systems and showing how products or materials can be transferred from one barge to another; and FIG. 12 is an elevational view showing a connection between the overhead crane support beams of two barges.

Figure 1:
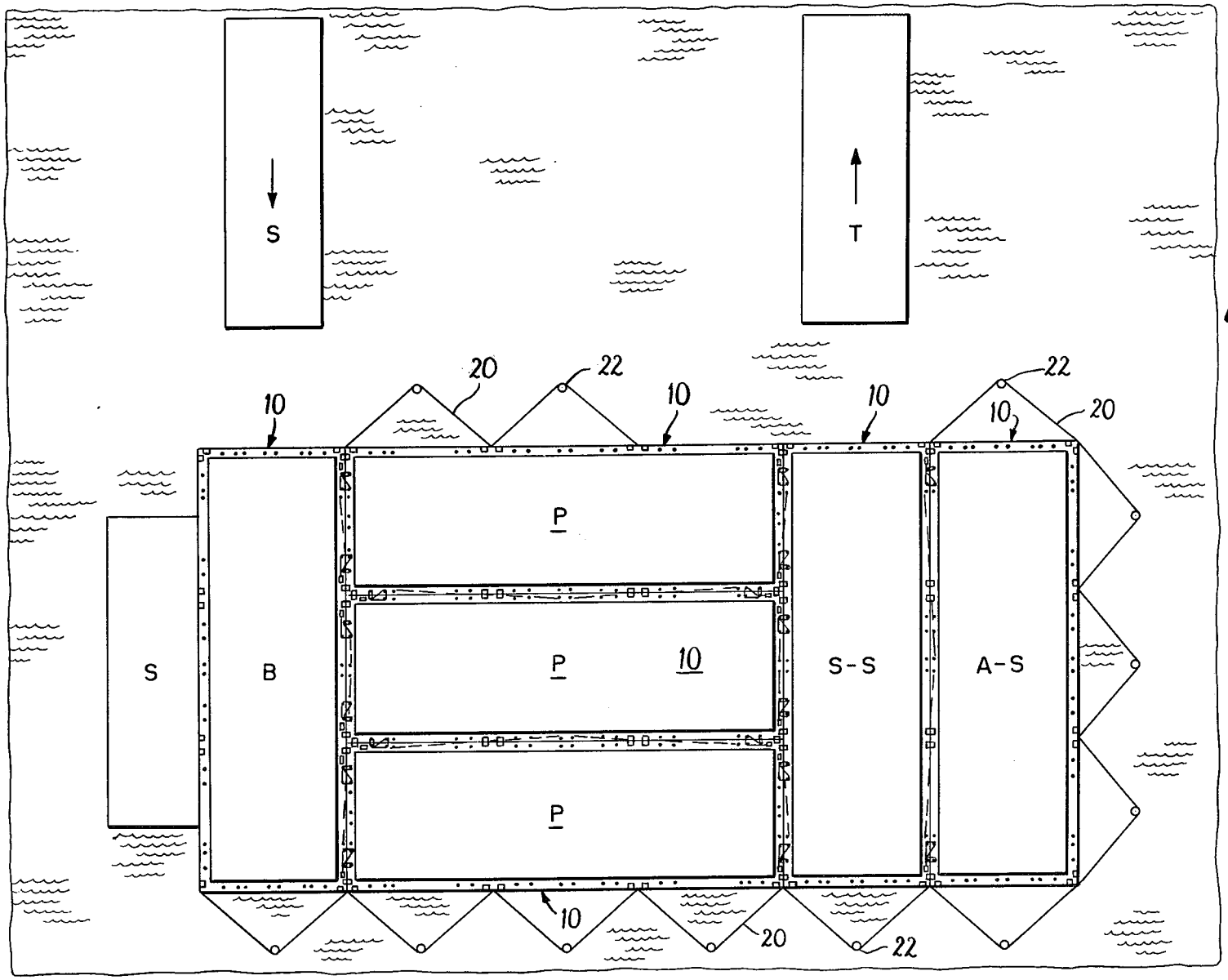
FIG. 1 is a generally schematic plan view of a typical layout of barges and shows one form of offshore mooring of the factory.

Referring to FIG. 1 of the drawings, a barge factory comprises several rectangular barges 10 of equal size, each of which is fitted out differently to provide for the required operations to be carried on in the factory. A typical factory for making concrete structural elements for buildings comprises the following barges:

1. An administration-storage barge A-S having the required office facilities, laboratory facilities, toilet, rest area and similar installations, some of which may be located below the deck and others in superstructure above the deck. In addition, if space permits, storage of supplies, some of the power equipment and various other installations may be made on the barge A-S. Generally, the barge A-S can be a permanently fitted out barge that is movable intact with the factory and requires virtually no work to make it ready for operation after transfer to a new site.
2. A batch plant B which is permanently fitted out with equipment for storing raw materials for concrete and for batching and mixing the concrete. Referring briefly to FIG. 10 of the drawings, the aggregate materials for concrete may be stored in above-the-deck bins, while cement can be stored in the hold of the barge. The batch plant barge B preferably includes a crane 14 for handling materials in the plant, as well as for taking materials from a supply barge 16 tied up along side and transferring them to the storage bins. The batch plant 18 is preferably located above deck and may be of any suitable design, many of which are well known to those skilled in the art.
3. A suitable number of production barges P fitted with the forms in which the various concrete products are manufactured, facilities for handling and assembling reinforcing materials, equipment for finishing the products and appropriate material handling systems for movement of the raw materials and products from place to place on each barge and between the several production barges. The particular production equipment used on the production barges P depends, of course, on the particular building system that is manufactured in the barge factory. The number of production barges and the total area they provide in the factory is also dependent on the type of system and the desired production rate. One or more barges can be fitted out with vertical pouring batteries that extend down into the hold of the barge. The holds of the production barges can also be utilized for curing the concrete products, for fabrication of reinforcing steel, for final finishing and for accommodation of support equipment. The details of the design of the production barges are well within the skill of the art, inasmuch as the technology of production line fabrication of reinforced and prestressed concrete products is highly developed.
4. A shipping and storage barge S-S equipped for short term storage of finished products produced on the production barges P and for transfer by appropriate material handling equipment of products from the barge factory to the shore.

The factory illustrated in FIG. 1 of the drawings is merely exemplary of various designs for the barge factory. The manner in which individual barges are fitted out and the degree to which the fitting out of the various barges is generally permanent or generally temporary depends on the end use of the factory. For example, if the barge factory is to be used for a number of projects, all of which involve the same construction system, all of the barges can be permanently fitted with highly sophisticated equipment suitable for a succession of projects to be carried on over many years at various sites. In that case, at the completion of a job, the barges are disconnected and moved to the new site, quickly reconnected and are ready to start a new job within as little as a few days. On the other hand, a floating factory that is intended for use for a period of years to produce components for a variety of building systems may be fitted out with more versatile types of concrete production equipment, that equipment being installed in a manner that will make it relatively easy to dismantle the equipment and replace it with other equipment tailored to another job.

FIG. 1 illustrates the factory in a typical offshore location, the factory being moored by cabling 20 to a series of pilings 22 suitably located around the perimeter of the factory. In an offshore location, supplies and raw materials for the factory are delivered on supply barges S, and finished products are taken from the factory to the shore by transport barges T. An offshore factory will include a suitable number of supply and transport barges that will be shuttled back and forth between the shore and the factory as required. As mentioned previously, delivery of aggregates and cement for the manufacture of concrete may be from remote locations by vessels provided by the suppliers of those materials.

Figure 2:
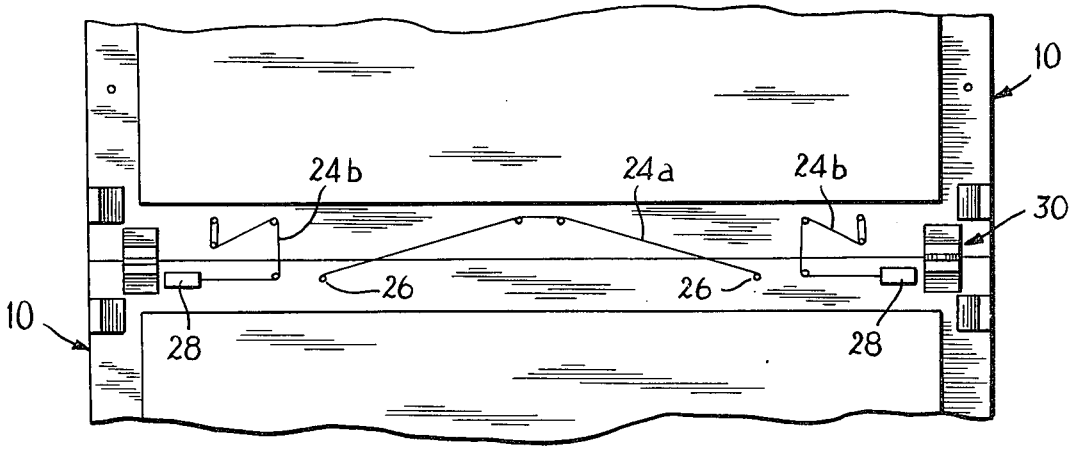
FIG. 2 is a generally schematic plan view showing exemplary connections between the ends of two adjacent barges on an enlarged scale, only portions of the two barges being shown.
Figure 3:
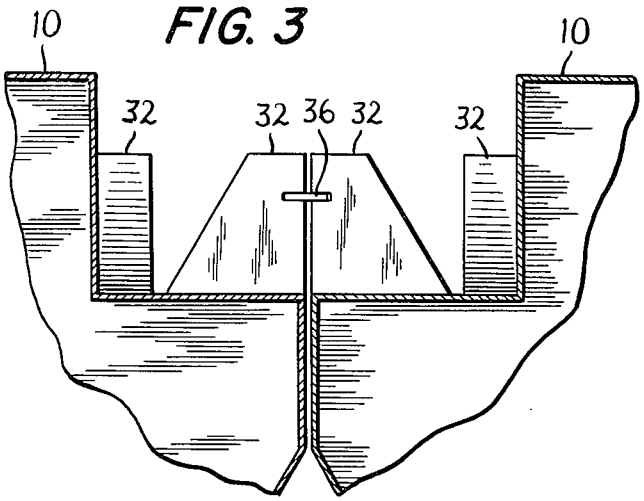
FIG. 3 is a cross-sectional view, again in generally schematic form taken at the juncture between two barges and showing an exemplary shear plate installation.
Figure 4:
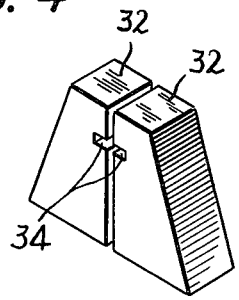
FIG. 4 is a pictorial view of the shear plate installation of FIG. 3.

As shown in FIG. 1, and on a larger scale at a typical installation in FIG. 2, the barges are connected to each other by systems of tie cables 24 located at suitable spacings at the junctures between adjacent barges. In a preferred form of barge, the main deck of the barge is elevated above a perimeter deck, and buttons 26 are located at suitable spacing along the perimeter deck. The cable tie systems are preferably constructed to provide a resilient, tensioned connection between adjacent barges, either by using long lengths of cable (e.g., the tie cable 24*a* of FIG. 2) and taking advantage of the inherent extensibility of the cable to provide resiliency in the connection or by providing constant tension winches 28 for maintaining a predetermined resilient connection between the barges (for example, the cable ties 24*b* shown in FIG. 2). The resilient interconnections between the barges permits moderate controlled movements of the barges under wave action, and movements of live loads about the factory while still providing an essentially stable level total work platform. The main decks of the barges can be connected by bridges or plates (not shown) that extend over the perimeter deck portions of adjacent barges.

Figure 5:
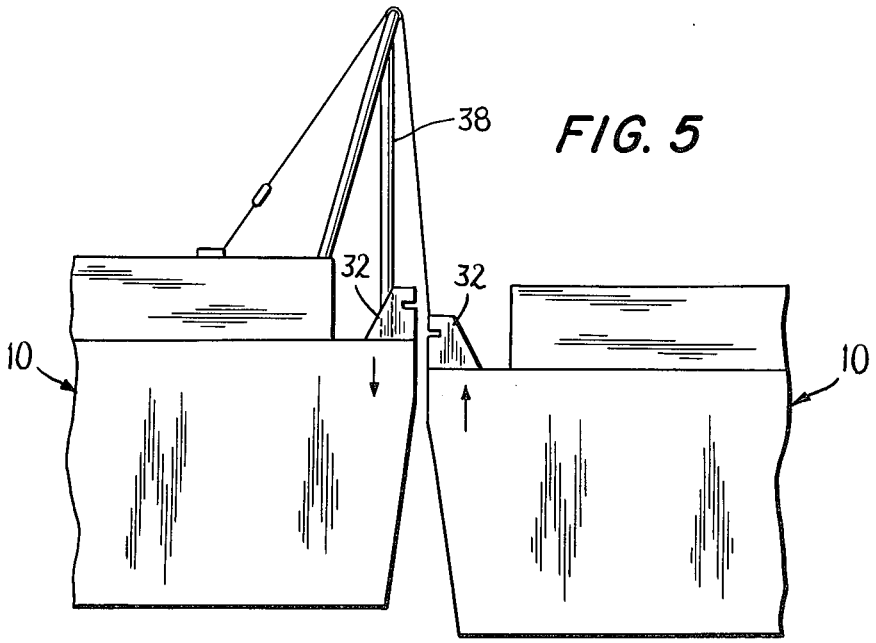
FIG. 5 is an elevational view illustrating a way of leveling adjacent barges to facilitate installation of a shear plate.

The connections between adjacent barges also include shear plate connectors 30 located at suitable spacing and in a suitable number along the perimeters of each barge. Each shear plate connector includes a structural member 32 that is tied strongly into the hull structure of the barge and having slots 34 that receive a flat shear plate 36. In the embodiment shown in FIGS. 2 to 5 of the drawings, the structural members 32 extend above the perimeter deck, and the slots open laterally so that the shear plate can be inserted from the side after the adjacent barges are brought into level position. As shown in FIG. 5, several portable temporary A-frames 38 can be set up and cables rigged to the usual winch equipment of the barge to assist in leveling adjacent barges for installation of the shear plates, the A-frame system being used to obtain final precise leveling after ballasting has brought the adjacent barges into approximate level. The shear plates enhance the stability of the factory work area by maintaining the adjacent edges of adjacent barges at the same level and by providing for transfer between adjacent barges of vertical forces due to water or wind action or as live load transfers from barge to barge take place in the operation of the factory. The shear connectors provide only essentially negligible resistance to movement of the barges toward and away from each other and parallel to each other in the horizontal direction, the cable tie system providing the restraining forces for controlling resiliently small relative movements of the barges in the horizontal direction. In other words, the concept of the connection system for joining the barges together to create a generally stable, level work platform splits the force transfer between barges between the two sub-systems, the shear plate sub-system for vertical force transfers and the tension cable tie sub-system for horizontal force transfers.

The splitting of a force transfer between two sub-systems permits each of the sub-systems to be designed for maximum effectiveness and greatly simplifies the structure involved as compared to a single system that must be designed for transfer of all forces between barges. It will be noted that the cable ties are loaded exclusively in tension, and the shear plates are loaded exclusively in shear - neither element carries combined stresses. The splitting of force transfer between the two sub-systems also permits tying the respective systems to different elements of the barge framework, thereby affording more even distribution of forces into the barge framework.

Figure 6:
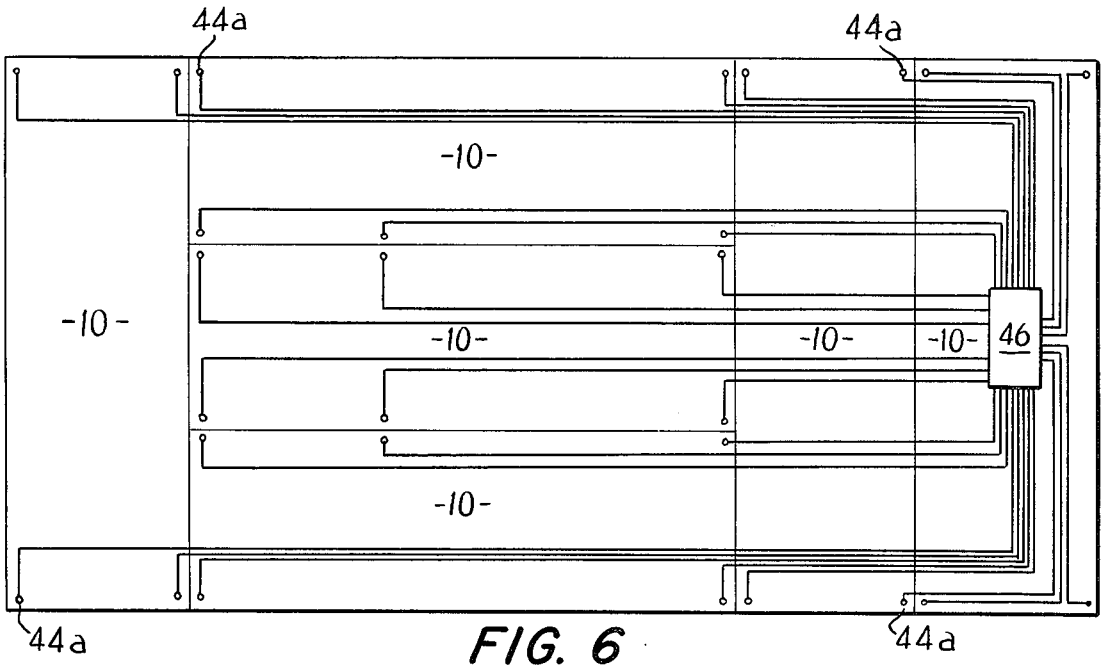
FIG. 6 is a schematic illustration of a detecting system for monitoring the orientations of the decks of all barges of the factory.
Figure 7:
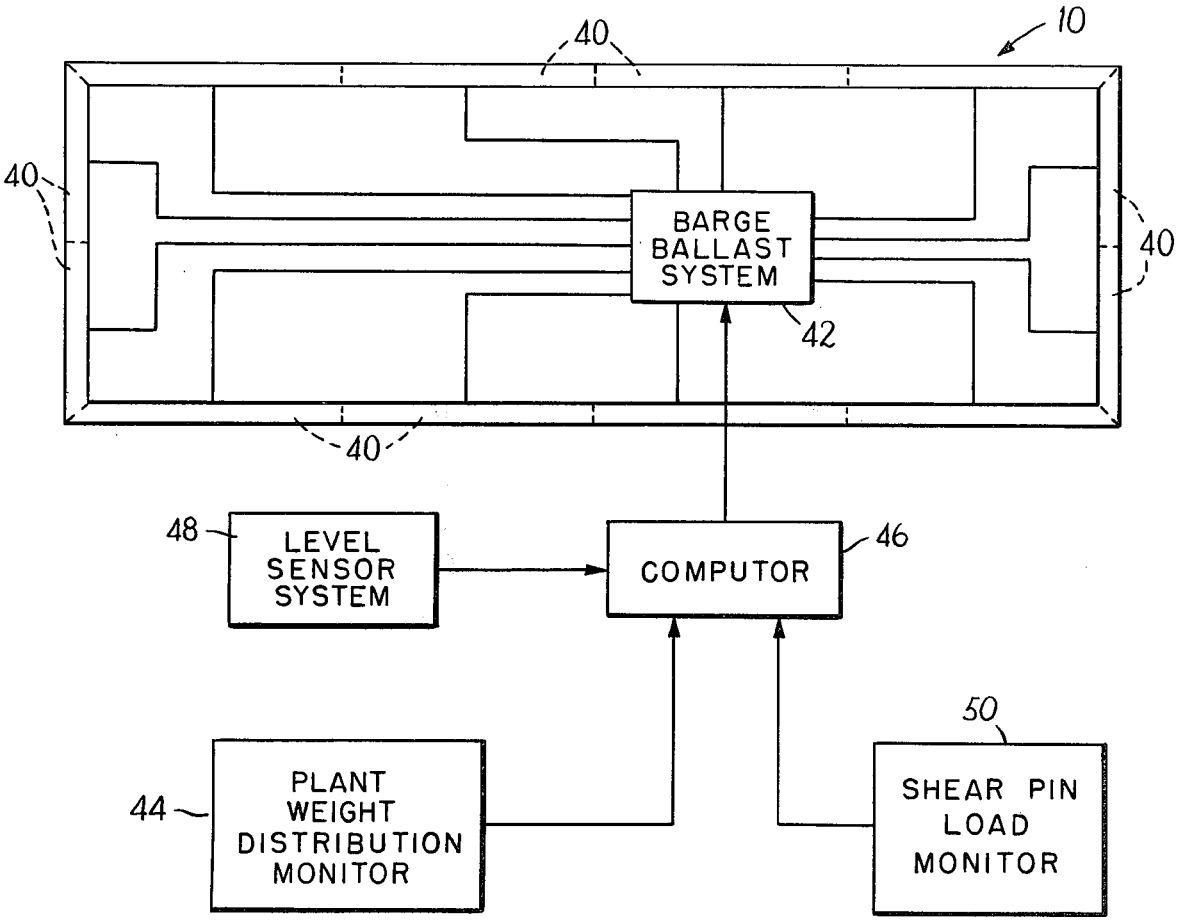
FIG. 7 is a schematic plan view of a barge that depicts the barge ballast system and the monitoring systems that are used to control ballast.

Referring to FIGS. 6 and 7 of the drawings, each barge of the barge factory is constructed with several separate ballast compartments 40 distributed along the length and width of the barge and a ballasting system 42 for selectively ballasting the individual compartments. For example, as illustrated in FIG. 7, the ballast compartments may be located between the inner and outer skins of the sides of the barge, and suitable pumping and piping installations made to permit the compartments 40 to be ballasted individually. All of the barges of the factory are integrated into a central ballast control system that includes one or more of the following sub-systems which are shown schematically in FIG. 7:

1. A plant weight distribution monitor 44 that is supplied with information relating to significant changes in loadings of the individual barges as well as overall loads on the factory. For example, when supplies are loaded onto the factory, the information as to the weight and location of those supplies is furnished to the monitor 44. Similarly, a major movement of materials, products or equipment from one location to another on the factory is monitored. The input to the plant weight distribution monitor 44 is processed into the factory computer 46 which determines the optimum way of adjusting the ballasting of the barges to maintain the decks of all the barges substantially in a plane. The interface between the computer 46 and the individual ballast systems 42 of each barge may be automatic or manual in that the output of the computer may be used to generate automatic control of the ballast systems of the barges, or information provided by the computer can be used for manual control of the ballast system of each barge.
2. A level sensor system 48 monitors the orientations of each barge and the orientations of the barges relative to each other and provides input to the computer 46 indicative of any predetermined change in the orientations of the decks of the individual barges. As shown in FIG. 6, for example, a level sensor at each corner of each barge is connected to a monitor and provides information indicative of the precise elevation of each corner of each barge. Such information is readily processed to provide a profile of the entire work area of the factory, and any predetermined variation from a desired profile triggers an input to the computer which is processed to provide as output automatic or visual instructions for changing the ballasting of the barges.
3. A shear plate load monitor 50 monitors the loading or stress on each shear plate employed in the connection systems and provides information to the computer relating to the steady-state loading (as distinguished from transient changes in loading) of any shear plate (or plates) beyond a predetermined load. The computer determines the optimum change in ballast that will correct the overload on the shear plates involved and provides as an output instructions or control signals for ballast changes.

The ballast control system of the factory may employ any or all of the sub-systems described above, and any other suitable system for monitoring the levels and the loadings of the several barges of the factory and for processing that information into changes in ballasting may be employed in lieu of or in addition to the examples set forth above.

Figure 8:
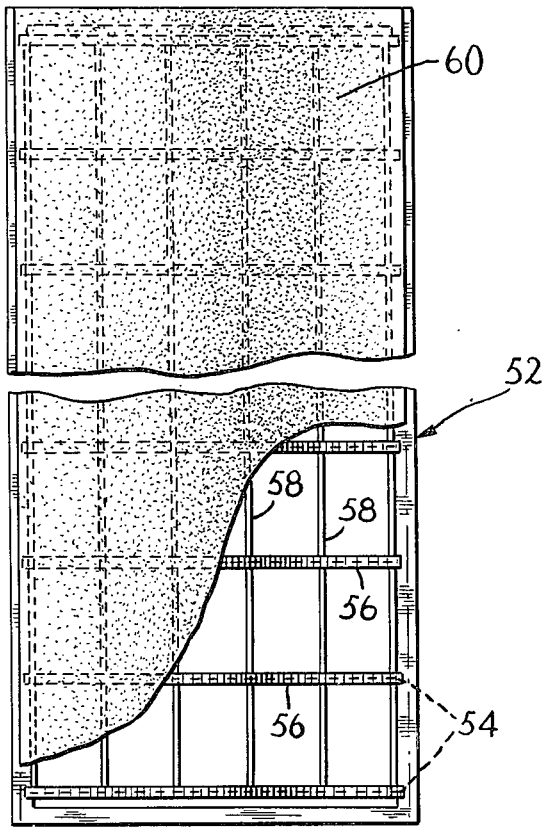
FIGS. 8 and 9 are plan and end elevational views, respectively, of the barge having a typical superstructure.
Figure 9:
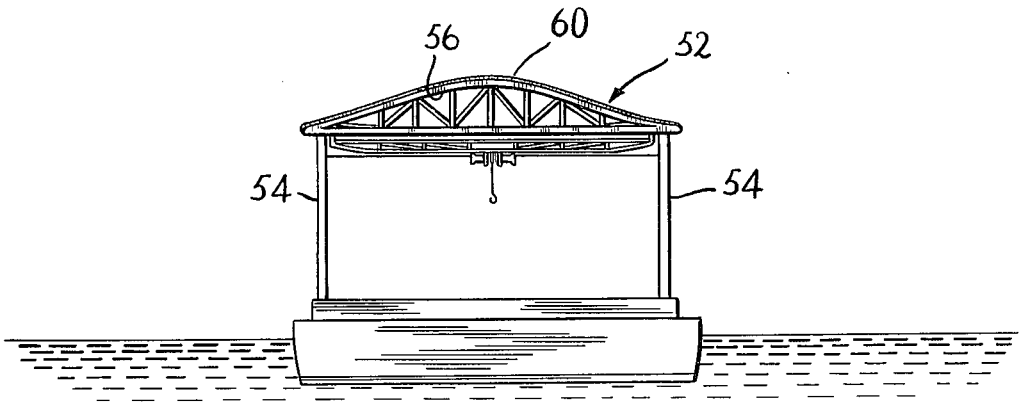

It is quite likely that the movement of the barges of the floating factory from one job site to another will involve passages through waterways that will require a maximum height limit or passages through open water that might through wind and water action damage the barge enclosure or impair the stability of the barge if it is transported with a large, relatively high superstructure in place. Thus, as shown in FIGS. 8 and 9 of the drawings, the superstructure 52 is constructed to be relatively easily dismantled. To that end, it is advantageous to employ a relatively lightweight framework composed of equally spaced columns 54 along each of the longer sides of the barge, lightweight roof trusses 56 extending between the columns over the main deck and lightweight stringers 58 extending longitudinally between the roof trusses 56. The side and end enclosures for the superstructure may be composed of rigid lightweight panels or of durable, flexible fabric panels connected to the columns in a manner to permit easy assembly and disassembly. The roofing 60 of the enclosure is a durable, flexible skin that is stretched over the roof framework, various heavy-duty, waterproof fabrics being suitable. A fabric roof skin, which may be one piece or several pieces appropriately joined and stretched over the framework, offers the advantages of being of relatively low cost, lightweight and easy to put on and remove. For relatively short passages in which severe weather and water action is unlikely, the barges of the factory can be moved from site to site without any disassembly of the superstructure, assuming that the height limitations along the passage permit. When water and weather conditions make it risky to leave all of the superstructure in place, the stability of the barge can be increased and the risk of harm to the superstructure can be reduced by removing the wall panels and the roof skin but leaving the framework in place, the removal of the wall panels and roof skin reducing windage and minimizing possible harm to the panels from heavy waves. In some cases, it will be desirable or necessary to dismantle all of the superstructure for movement of the barges from site to site. All parts of the superstructure that are taken off for movement of the barge from site to site may, of course, be stored on the main deck or in the hold of the barge during passage.

Various material handling systems that are used in conventional land factories are adapted for use on the barge factory. For example, each barge may, as shown in FIG. 12, have an overhead traveling crane 62 of the type commonly used in land-based factories of all sorts. As usual, the traveling crane runs along tracks on support beams 64 that extend along each side of the work area, in this case, the main deck of each barge, the beam being fastened to the roof trusses or to the columns on the barge. The main support beams and tracks 64 associated with two adjacent barges of the factory can be spliced to enable the traveling crane to move between barges by a splice connection (FIG. 12) comprising a special beam section 66 that is connected by pin connections 68 to the main crane support beams 64 of the two barges. The pin connections 68 are designed to allow longitudinal movement of the splice sections 66 relative to the respective main beams 64, thus accommodating motions of the adjacent barges.

Another suitable material handling system, as shown in FIG. 11, comprises a combination of overhead traveling cranes 62 on individual barges, particularly the production barges, and overhead monorail traveling cranes 70 on other barges. By extending the trackways of the traveling cranes 62 to allow a load to be carried over the edge of an adjacent barge, as shown in FIG. 11, materials and products can be transferred from barge to barge, the transfer including transfer from one crane to another. Traveling cranes are merely illustrative of the various material-handling systems that can be used in the floating barge factory. The stability of the work area enables conveyor systems, self-propelled or cable-drawn vehicles and other systems to be used for transport of materials, equipment and products about the factory.

We claim:

1. A factory for the manufacture of structural components for buildings and of similar large heavy objects comprising a multiplicity of separate floating barges arranged adjacent each other to provide an essentially continuous work area in which the decks of all barges are essentially level and lie substantially in a single plane, bridges connecting the decks of at least some of the side-by-side barges to each other for movement of personnel, materials and products among the several barges, material handling means for transporting materials, equipment and products from place to place in the work area and means for connecting the barges together to provide a generally stable working platform under conditions of water motion, the transfer of live loads from barge to barge and the like characterized in that the connecting means includes in combination cable ties connected between adjacent barges, the cable ties affording controlled tension to restrict relative movement of the barges in response to forces acting horizontally and to transfer horizontal forces between adjacent barges, and shear plate connector means including a structural member associated with each of the respective adjacent barges at a matching position thereon, each member having a socket, and shear plates separate from the structural members, one of the shear plates being received in the respective sockets of at least some of the matching members and bridging the juncture between at least some of the adjacent barges for providing vertical force transfer between the adjacent barges and for retaining the adjacent sides of the connected barges at essentially the same level.

2. A factory according to claim 1 and further characterized in that each socket is open laterally so that the shear plate received therein can be installed in the sockets of the structural members of adjacent barges, when aligned, by sliding it in from the side in a direction generally aligned with the juncture between the barges.

3. A factory according to claim 2 and further comprising lifting means on one barge raising an adjacent barge relative to said one barge and thereby aligning the respective sockets for receiving of the shear plate therein from one side of the structural member.

4. A factory according to claim 1 and further characterized in that the factory includes means for monitoring the movement of live loads among the several barges and the movement of loads on and off the work area and control means adjusting the ballasting of the several barges in accordance with changes in the loading of the several barges for maintaining the decks of the barges substantially in a plane.

5. A factory according to claim 4 and further characterized in that each barge includes means for determining changes in the orientation of the deck, relative to the horizontal, and means responsive to a predetermined change in the orientation of the deck of a barge for controlling the ballasting of the barges to reorient the decks of the barges to substantially a plane.

6. A factory according to claim 1 and further characterized in that at least some of the barges include enclosures for the deck, such enclosure for each barge including a roof composed of a structural framework and a sheet of flexible, durable material stretched over the framework and readily removable from the framework.

* * * * *